US011662761B2

(12) United States Patent
Sawai et al.

(10) Patent No.: US 11,662,761 B2
(45) Date of Patent: May 30, 2023

(54) REFERENCE VOLTAGE CIRCUIT

(71) Applicant: ABLIC Inc., Tokyo (JP)

(72) Inventors: Hideyuki Sawai, Tokyo (JP); Tsutomu Tomioka, Tokyo (JP)

(73) Assignee: ABLIC Inc., Tokyo (JP)

( * ) Notice: Subject to any disclaimer, the term of this patent is extended or adjusted under 35 U.S.C. 154(b) by 93 days.

(21) Appl. No.: 17/488,331

(22) Filed: Sep. 29, 2021

(65) Prior Publication Data

US 2022/0137660 A1 May 5, 2022

(30) Foreign Application Priority Data

Oct. 30, 2020 (JP) ..... JP2020-182127

(51) Int. Cl.
*G05F 3/30* (2006.01)
*G05F 3/26* (2006.01)

(52) U.S. Cl.
CPC ..... *G05F 3/30* (2013.01); *G05F 3/262* (2013.01)

(58) Field of Classification Search
CPC ..... G05F 3/262; G05F 3/30
See application file for complete search history.

(56) References Cited

U.S. PATENT DOCUMENTS 5,119,015 A * 6/1992 Watanabe ..... G05F 3/30 323/314
6,765,431 B1 * 7/2004 Coady ..... G05F 3/30 327/539
7,233,136 B2 * 6/2007 Makino ..... G05F 3/30 327/540
2005/0127987 A1 6/2005 Sato et al.
2006/0001413 A1 * 1/2006 Marinca ..... G05F 3/262 323/315

FOREIGN PATENT DOCUMENTS

JP 2005182113 7/2005

* cited by examiner

*Primary Examiner* — Jue Zhang
(74) *Attorney, Agent, or Firm* — JCIPRNET

(57) ABSTRACT

A reference voltage circuit includes: a first and a second NPN transistor having a collector and a base shorted and diode-connected, the second NPN transistor having an emitter connected to a first potential node and operating at a higher current density; a first resistor connected in series with the first NPN transistor; a second resistor having one end connected to a circuit with the first NPN transistor and the first resistor connected in series; a third resistor having one end connected to the collector of the second NPN transistor; a connection point to which the other ends of the second and the third resistor are connected; an arithmetic amplifier circuit having an inverting input terminal, a non-inverting input terminal, and an output terminal respectively connected to the second resistor, the third resistor, and the connection point; and a current supply circuit connected to the collector of the first NPN transistor.

4 Claims, 4 Drawing Sheets

REFERENCE VOLTAGE CIRCUIT

CROSS-REFERENCE TO RELATED APPLICATION

This application claims the priority benefits of Japanese application no. 2020-182127, filed on Oct. 30, 2020. The entirety of the above-mentioned patent application is hereby incorporated by reference herein and made a part of this specification.

BACKGROUND

Technical Field

The present invention relates to a reference voltage circuit.

Description of Related Art

A reference voltage circuit using NPN transistors has been proposed (see, for example, Japanese Laid-Open No. 2005-182113).

The reference voltage circuit described in Japanese Laid-Open No. 2005-182113 and shown in FIG. 5 includes a first NPN transistor Q41, a second NPN transistor Q42, an operational amplifier OP, and resistors 41, 42, 43 and 44, in which a reference voltage with no temperature characteristic is obtained by applying currents of the same value to the first NPN transistor Q41 and the second NPN transistor Q42 and adjusting (trimming) the resistor 44.

FIG. 6 is a schematic cross-sectional view of an NPN transistor. The NPN transistor is composed of an emitter 31, a base 32, and a collector 33. When the NPN transistor is formed on a PSUB board 34, the NPN transistor has a parasitic diode 35 between the collector 33 and the PSUB board 34 as shown in FIG. 7. Through this parasitic diode 35, a part of the current that should originally flow through the NPN transistor at a high temperature flows as a leakage current of the parasitic diode 35.

Further, in the reference voltage circuit of FIG. 5, the size of the first NPN transistor Q41 is set to be larger than the size of the second NPN transistor Q42. The same applies to the sizes of the parasitic diodes, and therefore the size of the parasitic diode of the first NPN transistor Q41 is larger than the size of the parasitic diode of the second NPN transistor Q42. In addition, the leakage current increases with the size of the parasitic diode. Thus, the leakage current flowing through the parasitic diode is larger in the first NPN transistor Q41 than in the second NPN transistor Q42. The currents flowing through the first NPN transistor Q41 and the second NPN transistor Q42 may deviate from the same current value originally set at a high temperature, and the reference voltage circuit of FIG. 5 has large temperature dependence.

SUMMARY

The present invention has an object to provide a reference voltage circuit having little temperature dependence.

A reference voltage circuit according to one aspect of the present invention includes: a first NPN transistor having a collector and a base shorted and diode-connected; a second NPN transistor having a collector and a base shorted and diode-connected, and having an emitter connected to a first potential node, and the second NPN transistor operating at a higher current density than the first NPN transistor; a first resistor connected in series with the first NPN transistor; a second resistor having one end connected to a circuit in which the first NPN transistor and the first resistor are connected in series; a third resistor having one end connected to the collector of the second NPN transistor; a connection point to which the other end of the second resistor and the other end of the third resistor are connected; an arithmetic amplifier circuit having an inverting input terminal connected to one end of the second resistor, a non-inverting input terminal connected to one end of the third resistor, and an output terminal connected to the connection point; and a current supply circuit connected to the collector of the first NPN transistor.

According to the present invention, a reference voltage having little temperature dependence can be provided.

DESCRIPTION OF THE EMBODIMENTS

Hereinafter, a reference voltage circuit according to an embodiment of the present invention will be described with reference to the drawings.

Figure 1:
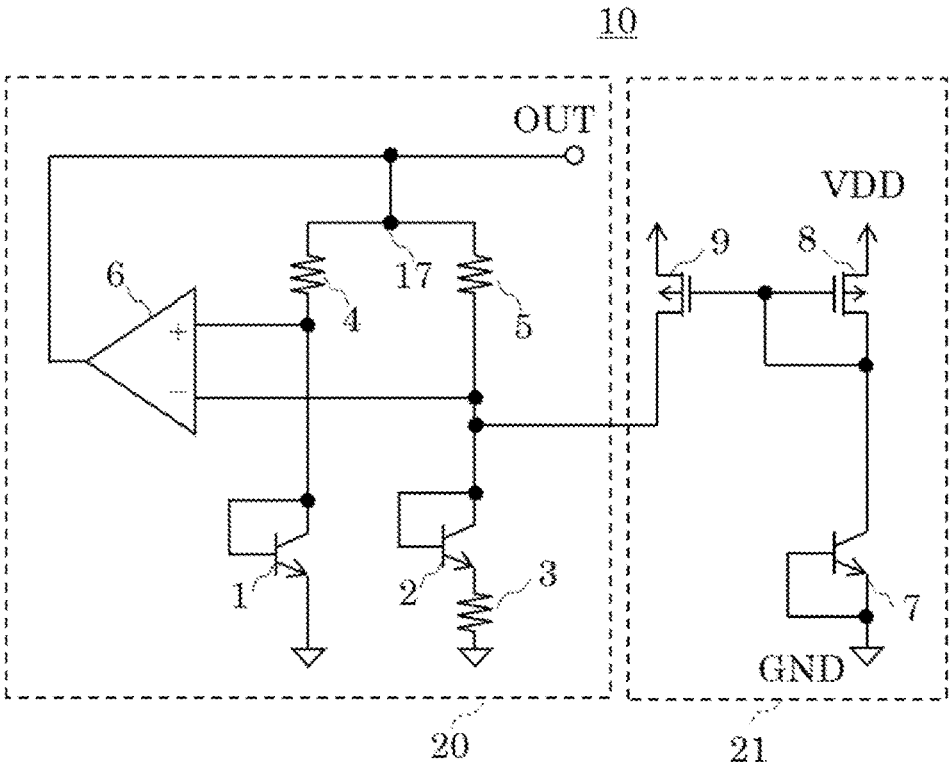
FIG. 1 is a circuit diagram showing a first configuration example of a reference voltage circuit according to an embodiment of the present invention.

FIG. 1 is a circuit diagram of a reference voltage circuit 10 which is an example (first configuration example) of the reference voltage circuit according to an embodiment of the present invention. The reference voltage circuit 10 includes a conventional reference voltage circuit 20 and a current supply circuit 21.

The conventional reference voltage circuit 20 includes NPN transistors 1 and 2, resistors 3, 4, and 5, an operational amplifier 6, and an OUT terminal. Here, the NPN transistor 2 is a transistor that has a larger transistor size than the NPN transistor 1. The resistor 4 and the resistor 5 have the same resistance value. The current supply circuit 21 includes an NPN transistor 7 and P-channel type MOS transistors 8 and 9.

Connection of the conventional reference voltage circuit 20 will be described. A base terminal and a collector terminal of the NPN transistor 1 are connected to each other and are connected to one end of the resistor 4. An emitter terminal is connected to a GND power supply. A base terminal and a collector terminal of the NPN transistor 2 are connected to each other and are connected to one end of the resistor 5. An emitter terminal is connected to a GND power supply via the resistor 3. Further, the base terminal and the collector terminal of the NPN transistor 2 are connected to a drain terminal of the P-channel type MOS transistor 9 of the current supply circuit 21. The other end of the resistor 4 and the other end of the resistor 5 are connected to a connection point 17. The operational amplifier 6 has a non-inverting input terminal connected to the collector terminal of the NPN transistor 1, an inverting input terminal connected to the collector terminal of the NPN transistor 2, and an output terminal connected to the connection point 17 and the OUT terminal. The description of a power supply of the operational amplifier 6 will be omitted.

Connection of the current supply circuit 21 will be described. The P-channel type MOS transistor 8 has a source terminal connected to a VDD power supply, and a gate terminal connected to the drain terminal, a gate terminal of the P-channel type MOS transistor 9, and a collector terminal of the NPN transistor 7. The P-channel type MOS transistor 9 has a source terminal connected to the VDD power supply, the gate terminal connected to the gate terminal of the P-channel type MOS transistor 8, and the drain terminal connected to the collector terminal of the NPN transistor 2 of the conventional reference voltage circuit 20. The NPN transistor 7 has the collector terminal connected to the drain terminal of the P-channel type MOS transistor 8, and a base terminal connected to the emitter terminal and a GND power supply. The P-channel type MOS transistor 8 and the P-channel type MOS transistor 9 form a current mirror circuit.

An operation of the conventional reference voltage circuit 20 will be described. The operational amplifier 6 amplifies a voltage of a difference between a voltage, which is obtained by adding a voltage generated in the resistor 3 and a base-emitter voltage VBE2 of the NPN transistor 2, and a base-emitter voltage VBE1 of the NPN transistor 1, and applies an output voltage of the operational amplifier 6 to the resistor 4 and the resistor 5.

Here, when the output voltage of the operational amplifier 6 is lower than a specified value, the current flowing through the resistor 4 and the resistor 5 is smaller than a specified value. Here, the resistance values of the resistor 4 and the resistor 5 are set relatively large, and the voltage drop values of the resistor 4 and the resistor 5 are set to be larger than the base-emitter voltage VBE1 of the NPN transistor 1 and the base-emitter voltage VBE2 of the NPN transistor 2. The base-emitter voltage VBE1 of the NPN transistor 1 and the base-emitter voltage VBE2 of the NPN transistor 2 have substantially the same values as the specified value. Therefore, assuming that the resistance value of the resistor 3 is a resistance value R3 and the current flowing through the resistor 3 is a current value IR3, the input potential of the non-inverting input terminal of the operational amplifier 6 is determined by the voltage VBE1, and the input potential of the inverting input terminal is determined by the voltage VBE2+the resistance value R3×the current value IR3. Since the current value IR3 is lower than the one when the output voltage is the specified value, the input voltage of the non-inverting input terminal becomes lower than the input potential of the inverting input terminal, and the output voltage of the operational amplifier 6 operates so as to go up and rises to a steady value.

When the output voltage of the operational amplifier 6 is higher than the specified value, the voltage generated in the resistor 3 becomes higher, and for the same reason as explained above, the input voltage of the inverting input terminal of the operational amplifier 6 becomes higher than the input voltage of the non-inverting input terminal, and the output voltage of the operational amplifier drops to a steady value.

When the operation of the reference voltage circuit 20 enters a stable state, the input voltages of the non-inverting input terminal and the inverting input terminal of the operational amplifier 6 have the same potential. Therefore, currents of the same value flow through the NPN transistor 1 and the NPN transistor 2. As described above, the transistor size of the NPN transistor 2 is larger than the transistor size of the NPN transistor 1. The NPN transistor 1 operates at a larger current density than the NPN transistor 2. A difference voltage ΔVBE between the base-emitter voltage VBE1 of the NPN transistor 1 and the base-emitter voltage VBE2 of the NPN transistor 2 is expressed by the following equation.

$$\Delta VBE = VBE1 - VBE2 = (KT/q) \times \ln N \quad \text{[Formula 1]}$$

Here, K is the Boltzmann constant, T is the absolute temperature, q is the charge amount, and N is the ratio of the transistor sizes of the NPN transistor 1 and the NPN transistor 2.

Therefore, a current of the voltage ΔVBE/the resistance value R3 flows through the resistor 3, and the current also flows through the resistor 5. Since currents of the same value flow through the NPN transistor 1 and the NPN transistor 2, and currents of the same value flow through the resistor 4 and the resistor 5, the output voltage of the operational amplifier 6 is expressed by the following equation.

$$VOUT = VBE1 + (\Delta VBE/R3) \times R4 \quad \text{[Formula 2]}$$

Here, R4 is the resistance value of the resistor 4. Since the value of the voltage ΔVBE is proportional to the absolute temperature T as shown in the previous equation, the voltage ΔVBE increases as the temperature rises, but since the voltage VBE1 decreases as the temperature rises, it is possible to generate a reference voltage with no temperature characteristic by appropriately selecting the resistance values of the resistors 3, 4, and 5.

Figure 6:
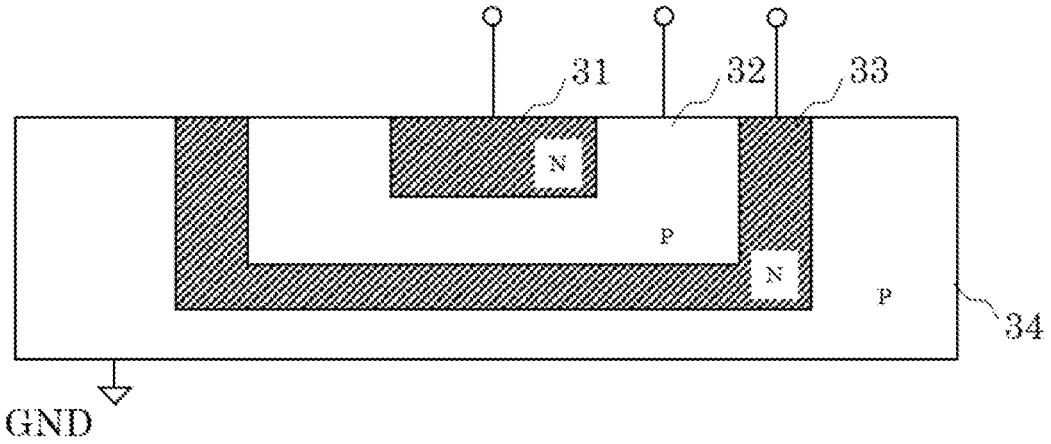
FIG. 6 (Related Art)
FIG. 6 is a cross-sectional view showing a structure of a general NPN transistor.
Figure 7:
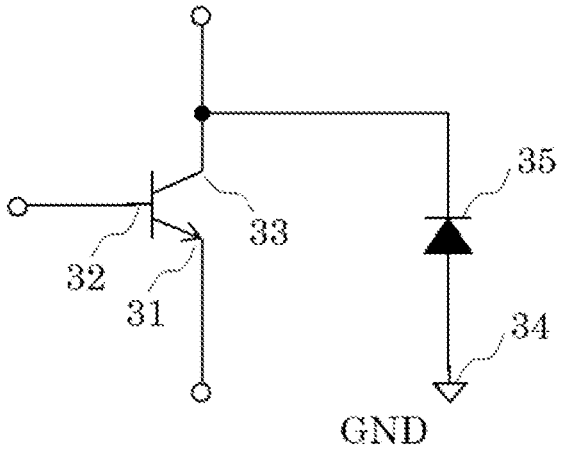
FIG. 7 (Related Art)
FIG. 7 is a circuit diagram showing an equivalent circuit of a general NPN transistor.

When the reference voltage circuit is built in an integrated circuit, the NPN transistors may be formed on a PSUB board. FIG. 6 shows a cross-sectional view of an NPN transistor formed on a PSUB board. Further, FIG. 7 shows an equivalent circuit of an NPN transistor formed on a PSUB board.

In the NPN transistor formed on a PSUB board 34, the first N-type diffusion layer serves as a collector 33, the P-type diffusion layer serves as a base 32, and the second N-type diffusion layer serves as an emitter 31. At the same time, a parasitic diode 35 is formed by the PSUB board 34 and the first N-type diffusion layer which is the collector 33.

Since a reverse bias voltage is applied during the operation of the NPN transistor, the parasitic diode 35 usually has no effect on the operation of the NPN transistor. However, in the parasitic diode 35 to which the reverse bias voltage is applied, a minute leakage current flows from the cathode to the anode. The leakage current flowing through the parasitic diode 35 has temperature dependence, and a larger leakage current flows at a higher temperature.

In the conventional reference voltage circuit 20 shown in FIG. 1, both the NPN transistor 1 and the NPN transistor 2 have parasitic diodes, and a part of the current flowing through each of the NPN transistor 1 and the NPN transistor 2 flows to the GND power supply via the parasitic diode. Here, since the transistor size of the NPN transistor 2 is larger than the transistor size of the NPN transistor 1, the parasitic diode of the NPN transistor 2 also has a larger diode size than the parasitic diode of the NPN transistor 1.

In order to generate a reference voltage with little temperature dependence, it is required for the NPN transistor 1 and the NPN transistor 2 to have equal currents flowing therethrough. However, since the parasitic diode existing in the NPN transistor 2 has a larger diode size than the NPN transistor 1, the leakage current flowing through the parasitic diode at a high temperature is also large. At a high temperature, the current flowing through the NPN transistor 2 decreases more than the current flowing through the NPN transistor 1. As a result, there is a difference between the currents flowing through the NPN transistor 1 and the NPN transistor 2. The conventional reference voltage circuit formed on the PSUB board cannot generate a reference voltage having little temperature dependence, and the generated reference voltage has temperature dependence.

Therefore, in this embodiment, the current supply circuit 21 is connected to the collector of the NPN transistor 2. The NPN transistor 7 of the current supply circuit 21 has a parasitic diode, and a leakage current flows in the same manner as in the NPN transistor 2. The current supply circuit 21 supplies the leakage current flowing through the NPN transistor 7 to the collector of the NPN transistor 2 via the current mirror circuit formed by the P-channel type MOS transistor 8 and the P-channel type MOS transistor 9.

By adjusting the transistor size of the NPN transistor 7 and the mirror ratio of the current mirror circuit, the currents flowing through the NPN transistor 1 and the NPN transistor 2 can be set to be equal. Specifically, the transistor size adjustment of the NPN transistor 7 can be realized by connecting a plurality of NPN transistors in parallel to form the NPN transistor 7 and, if necessary, separating a part of the plurality of transistors from the circuit by trimming or the like. Similarly, the adjustment of the mirror ratio of the current mirror circuit can be realized by connecting a plurality of P-channel type MOS transistors in parallel to form one transistor that constitutes the current mirror circuit and, if necessary, separating a part of the plurality of P-channel type MOS transistors from the circuit by trimming or the like.

Figure 2:
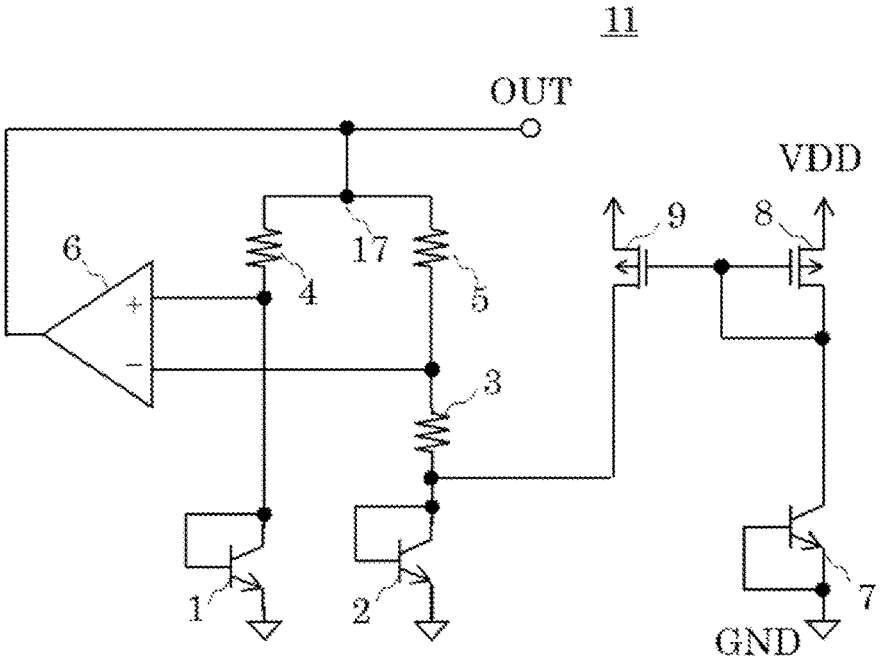
FIG. 2 is a circuit diagram showing a second configuration example of a reference voltage circuit according to the embodiment.

Here, the resistor 3 is connected between the NPN transistor 2 and the GND power supply, but like a reference voltage circuit 11 of a second configuration example shown in FIG. 2, the resistor 3 may be connected between the resistor 5 and the NPN transistor 2, the inverting input terminal of the operational amplifier 6 may be connected to the connection point of the resistor 3 and the resistor 5, the current supply circuit 21 may be connected to the collector of the NPN transistor 2 as in FIG. 1, and the emitter of the NPN transistor 2 may be connected to the GND power supply.

Figure 3:
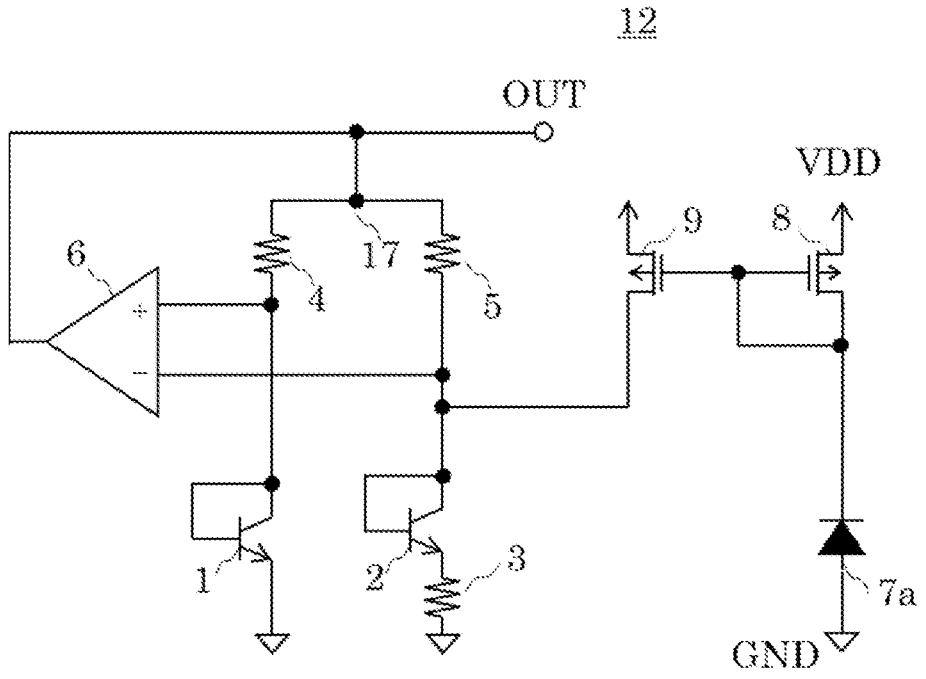
FIG. 3 is a circuit diagram showing a third configuration example of a reference voltage circuit according to the embodiment.

Further, the NPN transistor 7 may be a diode 7*a* as in a reference voltage circuit 12 of a third configuration example shown in FIG. 3. The diode 7*a* has a cathode terminal connected to the drain terminal of the P-channel type MOS transistor 8, and an anode terminal connected to the GND power supply. The diode 7*a* is provided with only the parasitic diode of the NPN transistor 7, and a leakage current similar to the leakage current of the NPN transistor 7 flows.

Figure 4:
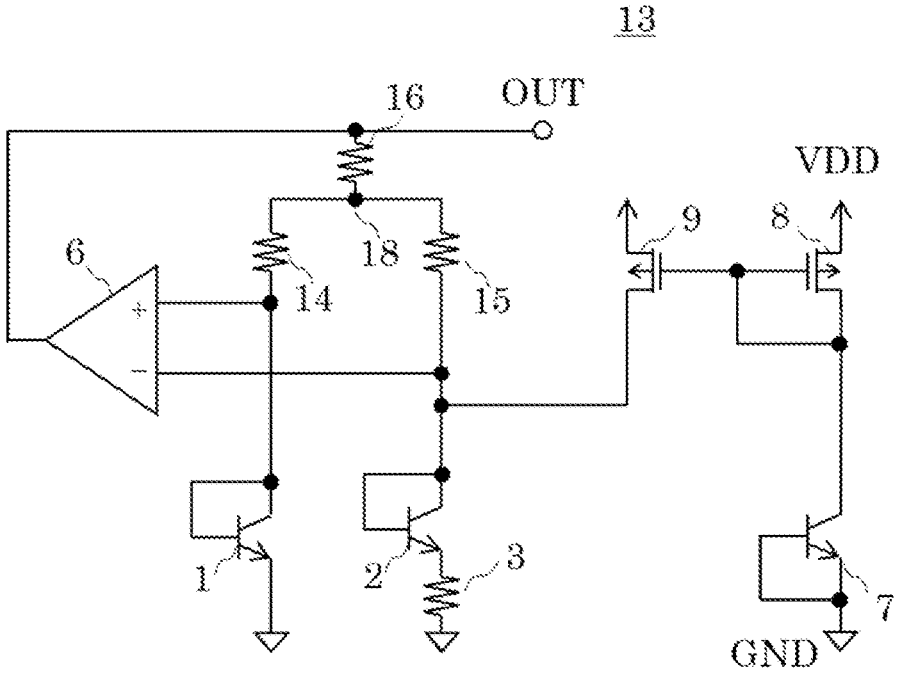
FIG. 4 is a circuit diagram showing a fourth configuration example of a reference voltage circuit according to the embodiment.
Figure 5:
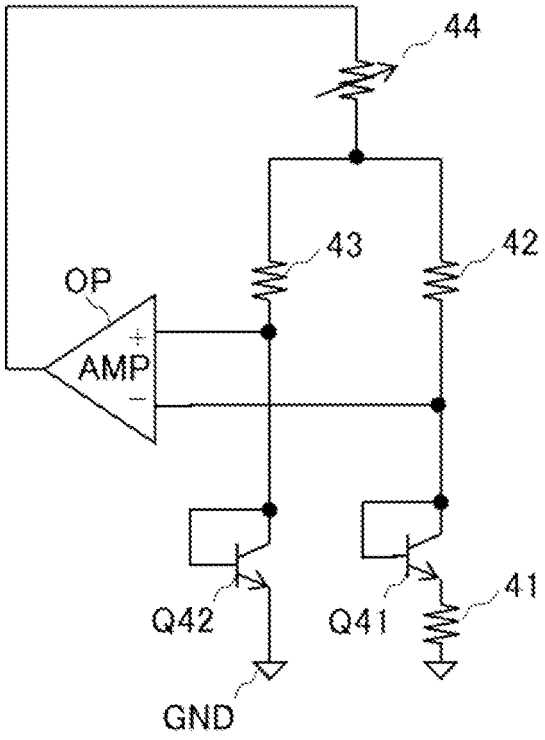
FIG. 5 (Related Art)
FIG. 5 is a circuit diagram showing an example of a conventional reference voltage circuit having NPN transistors.

Further, the resistor 4 and the resistor 5 may be constituted by a resistor 14, a resistor 15, and a resistor 16 as in a reference voltage circuit 13 of a fourth configuration example shown in FIG. 4. One end of the resistor 14 is connected to the collector terminal of the NPN transistor 1, and the other end is connected to a connection point 18. One end of the resistor 15 is connected to the collector terminal of the NPN transistor 2, and the other end is connected to the connection point 18. One end of the resistor 16 is connected to the connection point 18, and the other end is connected to the output terminal of the operational amplifier 6. The fourth configuration example is a configuration in which a part of the resistor 4 and the resistor 5 are replaced with the resistor 16.

The reference voltage circuit 10 of this embodiment includes the conventional reference voltage circuit 20 and the current supply circuit 21. By compensating the leakage current flowing through the parasitic diode of the NPN transistor 2 with the current supply circuit 21, the reference voltage circuit 10 can set the currents flowing through the main body of the NPN transistor 1 and the main body of the NPN transistor 2 that generate the reference voltage to be the same regardless of the temperature, and can generate the reference voltage having little temperature dependence.

Nevertheless, the present invention is not limited to the embodiments as described above. At the implementation stage, the present invention can be implemented in various forms other than the above-described examples, and various omissions, replacements, and changes can be made without departing from the gist of the present invention. For example, each switch described in the embodiments of the present invention may be constituted by a PMOS transistor or an NMOS transistor. These embodiments and modifications thereof are included in the scope and gist of the present invention, and are also included in the scope of the present invention defined in the claims and the equivalent scope thereof.

What is claimed is:

1. A reference voltage circuit, comprising:

a first NPN transistor having a collector and a base shorted and diode-connected;

a second NPN transistor having a collector and a base shorted and diode-connected, and having an emitter connected to a first potential node, and the second NPN transistor operating at a higher current density than the first NPN transistor;

a first resistor connected in series with the first NPN transistor;

a second resistor having one end connected to a circuit in which the first NPN transistor and the first resistor are connected in series;

a third resistor having one end connected to the collector of the second NPN transistor;

a connection point to which an other end of the second resistor and an other end of the third resistor are connected;

an arithmetic amplifier circuit having an inverting input terminal connected to one end of the second resistor, a non-inverting input terminal connected to one end of the third resistor, and an output terminal connected to the connection point; and a current supply circuit connected to the collector of the first NPN transistor.

2. The reference voltage circuit according to claim 1, wherein the current supply circuit comprises a diode having an anode connected to the first potential node, and a fourth transistor and a fifth transistor which constitute a current mirror circuit, and a current flowing through the diode is supplied to the collector of the first NPN transistor via the current mirror circuit.

3. The reference voltage circuit according to claim 1, wherein the current supply circuit comprises a third NPN transistor having an emitter and a base shorted and diode-connected, and a fourth transistor and a fifth transistor which constitute a current mirror circuit, and a current flowing through the third NPN transistor is supplied to the collector of the first NPN transistor via the current mirror circuit.

4. The reference voltage circuit according to claim 1, wherein the connection point is connected to the output terminal of the arithmetic amplifier circuit via a fourth resistor.

* * * * *